US008926477B2

(12) United States Patent
Lynn

(10) Patent No.: US 8,926,477 B2
(45) Date of Patent: Jan. 6, 2015

(54) COMBINED BEVERAGE HOLDER AND EXERCISE APPARATUS

(75) Inventor: John Morris Lynn, Austin, TX (US)

(73) Assignee: Mug Muscles, LLC

( * ) Notice: Subject to any disclaimer, the term of this patent is extended or adjusted under 35 U.S.C. 154(b) by 299 days.

(21) Appl. No.: 13/424,908

(22) Filed: Mar. 20, 2012

(65) Prior Publication Data

US 2013/0012358 A1 Jan. 10, 2013

Related U.S. Application Data

(60) Provisional application No. 61/571,787, filed on Jul. 5, 2011, provisional application No. 61/626,820, filed on Oct. 3, 2011, provisional application No. 61/631,114, filed on Dec. 27, 2011.

(51) Int. Cl.

| | |
|---|---|
| ***A63B 23/16*** | (2006.01) |
| ***A63B 21/045*** | (2006.01) |
| ***A63B 21/02*** | (2006.01) |
| ***A63B 21/04*** | (2006.01) |
| ***A63B 21/00*** | (2006.01) |
| *A63B 71/06* | (2006.01) |
| *A63B 21/005* | (2006.01) |

(52) U.S. Cl.

CPC ..... *A63B 23/16* (2013.01); *A63B 21/025* (2013.01); *A63B 21/0421* (2013.01); *A63B 21/00043* (2013.01); *A63B 71/0622* (2013.01); *A63B 2021/0055* (2013.01); *A63B 2225/682* (2013.01)

USPC ..... 482/49; 482/127

(58) Field of Classification Search

CPC ..... A63B 21/045; A63B 23/16

USPC ..... 482/44–50, 79, 91–93, 106–108, 482/121–122, 124, 126–128, 148, 904, 910

See application file for complete search history.

(56) References Cited

U.S. PATENT DOCUMENTS 1,026,215 A * 5/1912 Korth ..... 482/50
4,120,073 A * 10/1978 Studebaker ..... 294/33

(Continued)

FOREIGN PATENT DOCUMENTS

| | | |
|---|---|---|
| AT | 384948 B | 1/1988 |
| AT | 388298 B | 5/1989 |
| EP | 0214121 B1 | 3/1987 |

OTHER PUBLICATIONS

Ebay.com, "Beerbell Beer Mug Stein 1 1/4 lb. Iron Weight Barbell Exercise While You Drink", http://www.ebay.com/itm/BEERBELL-BEER-MUG-STEIN-1-1-4-1b-Iron-Weight-barbell-Exercise-While-You-Drink-/251128064941?pt=LH_DefaultDomain_0&hash=item3a78662bad, Aug. 29, 2012.

(Continued)

*Primary Examiner* — Oren Ginsberg

(74) *Attorney, Agent, or Firm* — The Law Firm of H. Dale Langley, Jr. P.C.

(57) ABSTRACT

An apparatus combines a beverage holder (e.g., a mug) with a compressible device (i.e., a gripper or handgrip) that is usable as an exercise apparatus for a users hands, wrists or forearms. This dual purpose apparatus can function not only as a mug or insulator but also a squeezable exercise device whereby flexing and relaxing a user's hand, the user conditions their hands, wrists or forearms. The device may also include lights or audio. In some embodiments the handgrip may be detachably attached to the beverage container to allow the independent use of the holder and handgrip.

6 Claims, 4 Drawing Sheets

(56) References Cited

U.S. PATENT DOCUMENTS

| | | | | | |
|---|---|---|---|---|---|
| 4,651,988 | A | * | 3/1987 | Sobel | 482/139 |
| 4,703,927 | A | * | 11/1987 | Hanzlik | 482/74 |
| 4,798,377 | A | * | 1/1989 | White | 482/49 |
| 5,318,492 | A | * | 6/1994 | Quinn | 482/108 |
| 5,332,119 | A | * | 7/1994 | Davis | 222/78 |
| 5,472,400 | A | * | 12/1995 | Royer | 482/141 |
| 5,580,343 | A | * | 12/1996 | Cafiero | 482/139 |
| 5,857,946 | A | * | 1/1999 | Brown | 482/108 |
| D431,060 | S | * | 9/2000 | Wyrick | D21/684 |
| D456,215 | S | | 4/2002 | DuBow | |
| 6,565,485 | B1 | * | 5/2003 | Kinsella | 482/49 |
| 7,362,231 | B2 | | 4/2008 | Bos | |
| 7,726,499 | B2 | * | 6/2010 | Williamson et al. | 215/396 |
| 2007/0051735 | A1 | | 3/2007 | Taylor et al. | |

OTHER PUBLICATIONS

WorthPoint.com, "The Beer Bell Mug—Exercise While You Drink Book", http://www.worthpoint.com/worthopedia/beer-bell-mug-exercise-drink-book-115127468, Aug. 29, 2012.

* cited by examiner

COMBINED BEVERAGE HOLDER AND EXERCISE APPARATUS

CROSS REFERENCE TO RELATED APPLICATIONS

This application claims priority under 35 U.S.C. Section 119(e) to U.S. Provisional Patent Application Ser. No. 61/571,787 filed Jul. 5, 2011; U.S. Provisional Patent Application Ser. No. 61/626,820 filed Oct. 3, 2011 and U.S. Provisional Patent Application Ser. No. 61/631,114 filed Dec. 27, 2011. The contents of these provisional applications are hereby incorporated by reference in their entirety.

TECHNICAL FIELD

This invention generally relates to containers and exercise equipment and more particularly relates to an apparatus that serves as both a holder for a beverage and also an exercise apparatus for the hands, wrist or forearms. The device may also include lights and audio.

BACKGROUND

Beverage holders such as mugs, glasses, cups, steins, bottles and so forth have been used for centuries so that various beverages can be conveniently consumed. Also insulating devices (sometimes known as Koozies™) have been known for many years to help keep a beverage either warm or cold. Insulating beverage holders can be designed to fit standard bottle sizes or standard beverage cans. Insulating beverage holders are often sold or given away by beverage companies since they can be used as advertising vehicles (i.e. the outside surface of the Koozie has advertising space for commercial entities). Koozies are typically designed to snugly fit around either the bottle or can of the beverage. Likewise, most beverage bottles and cans in a single serving size are designed to fit comfortably into a user's hand. Drinking beverages (particularly alcoholic beverages) is sometimes considered to be a sedentary activity. In fact, for many years the poster child for the inactive, overweight "couch potato" is a man sitting on a couch drinking a beer while watching some sports event.

Grippers are often used by persons involved in sports where hand, wrist or forearm strength is crucial (e.g. tennis, baseball, football, rugby, basketball, golf and so forth). Grippers can be as simple as a circular spring with V-shaped handles that are attached to the two legs coming off the spring. These single spring grippers include, for example, Tiger Claw Hand Exercise Grips from Amazon.com, Extra Strength Hand Grip from Everlast Worldwide, Inc. and Heavy Grip from Heavy Sports, Inc. In addition, more complex grippers with multiple springs (sometimes one for each finger) include, for example, GripMaster Hand Exerciser from Accu-Net, LLC. Compressible balls or spheres, such as foam shaped ball or sphere or a ball or sphere with a resilient rubber like covering filled with dry particles or pellets, can also be used for exercise. Exercise grippers are disclosed, for example, in a series of US patents by Mark A Scatterday, including U.S. Pat. Nos. 5,190,504, 5,350,342, 5,716,303, 6,210,304, 6,059,249, 6,482,129, and 6,162,149 (hereinafter the Scatterday patents). Some compressible ball apparatuses are, for example, the GHS Handmaster Plus Hand Exerciser and the DynaFlex Platinum Powerball, both available from Amazon.

It would be a significant improvement and advance to combine exercise with beverage drinking.

SUMMARY

In certain embodiments, an apparatus serve as an insulating device to keep the beverage either hot or cold. The apparatus includes a gripper. In at least one embodiment of the invention, the exercise apparatus portion of the combined apparatus is a hand compressible apparatus. As a user repeatedly compresses and then releases the compressible hand apparatus (also called a "gripper") this exercises their hand muscles, wrist muscles and forearm muscles. The term "gripper", as used herein, is meant to broadly include any of a large number of squeezable hand exercise apparatuses including but not limited to ones with single springs, multiple springs and grippers without springs made of compressible materials such as rubber, elastomers or dry flowable sand or other small spheres.

In at least one embodiment of the invention, mechanical grippers with springs are attached to a handle of a beverage holder such as a mug. The gripper may be an integral part of the mug handle or may be detachably attached to the mug handle.

In another embodiment of the invention, the gripper is either attached to or an integral part of a "Koozie" ™ type beverage holder (hereinafter called "insulating beverage holders").

In embodiments using insulating beverage holders (rather than mugs with handles), the gripper may not be a mechanical apparatus with a spring or springs but instead it might be a compressible material such as a compressible ball.

BRIEF DESCRIPTION OF THE DRAWINGS

A more complete and thorough understanding of the present disclosure and its advantages may be acquired by referring to the detailed description below in conjunction with the drawings referenced immediately below:

FIG. 2(*b*) is a perspective view of the same mug and gripper of FIG. 5(*a*) but with the gripper attached to the mug.

FIG. 4(*b*) is a cutaway view of a beverage can with an insulating beverage holder having a compressible area usable as an exercise apparatus.

FIG. 5(*b*) is a cutaway view of a beverage bottle with a compressible doughnut shaped insulating beverage holder that is intended to be slipped over the top of the bottle wherein the compressible doughnut shaped bottle holder also has a skirt extending below the doughnut that covers much of the bottle.

FIG. 5(*c*) is a frontal perspective view of a beverage bottle with a compressible doughnut shaped bottle holder that is intended to be slipped over the top of the bottle.

DETAILED DESCRIPTION

Figure 1:
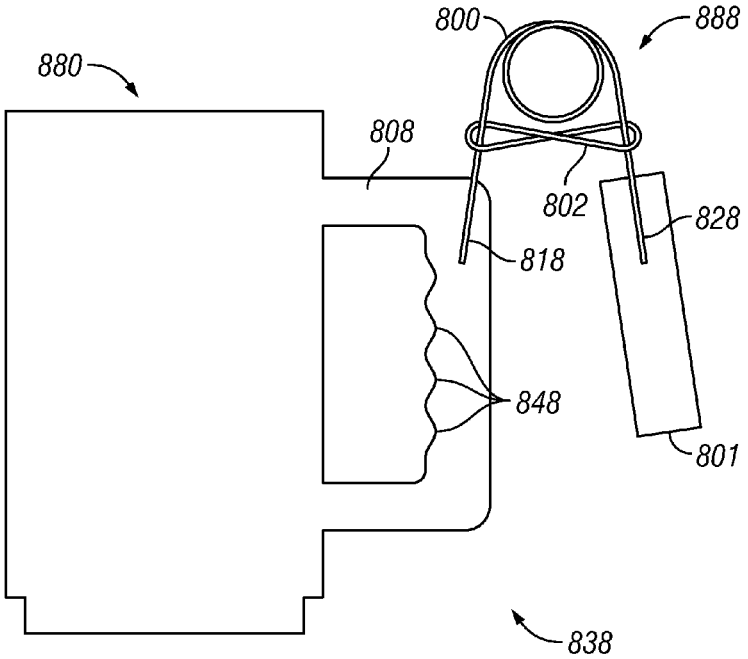
FIG. 1 is a perspective view of a mug with a handle that has a gripper incorporated as an integral part of the mug handle.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As may be used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged", "incorporated" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . " Further, reference herein and in the appended claims to components and aspects in a singular tense does not necessarily limit the present disclosure or appended claims to only one such component or aspect, but should be interpreted generally to mean one or more, as may be suitable and desirable in each particular instance.

FIG. 1 is a perspective view of at least one embodiment of a combined beverage holder and exercise apparatus 838. Apparatus 838 comprises gripper 888 that is attached as an integral part to beverage holder 880. Beverage holder 880 in this embodiment is a traditional mug with handle 808. Gripper 888 comprises spring 800 with integral legs 818 and 828. Legs 818 and 828 are kept in a V-shape by restrictor 802 when gripper 888 is not being squeezed or compressed by a user. Squeezing or compressing gripper 888 brings legs 818 and 828 into a more parallel configuration until the user releases their grip and spring 888 returns to its uncompressed V-shape against restrictor 802. Gripper 888 is commercially available from Amazon.com under trade name Tiger Claw Hand Exercise Grips.

Apparatus 838 allows a user to enjoy a beverage such as a beer while also exercising his hand, wrist and forearm while compressing spring 888. Handle 808 may include finger guides 848 on the interior side of handle 808 to make it more comfortable for the user.

There are a number of different ways of attaching a gripper to a beverage holder. One method of making combination apparatus 838 is to make both beverage holder 880 (including handle 808) and gripper handle 801 out of the same plastic using injection molding processes well known in the art. Spring 888 can be integrally attached to both mug 880 and grip handle 801 by over molding mug 880 and handle 801 over legs 818 and 828 of spring 888. In some embodiments where a transparent mug is desired the injection plastic may be a polycarbonate.

Another way of permanently attaching gripper 888 to a mug handle 808 is to injection mold mug 880 such that mug handle 808 has a cavity sized to fit a leg of the gripper (not expressly shown) and to insert gripper leg 818 into the cavity and attach it with an adhesive such as an epoxy glue. In another embodiment (not expressly shown) handle 801 can have a foam or elastic comfort sleeve slipped over handle 801 for either comfort or improved grip.

Figure 2A:
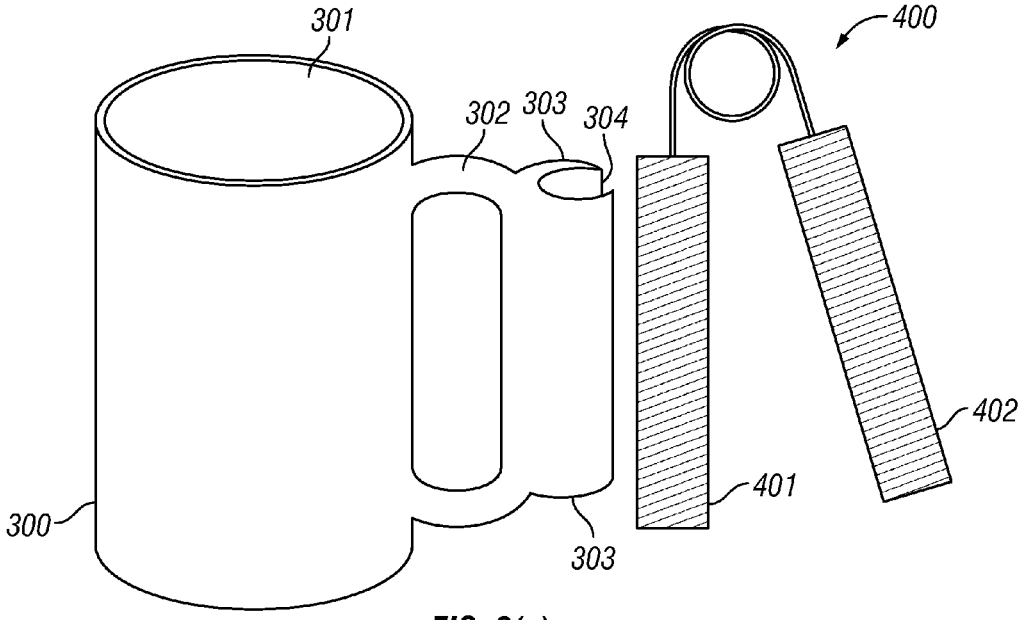
FIG. 2(*a*) is a perspective view of a mug with a coupler on the handle and an independent gripper when the two apparatuses are not in combination.
Figure 2B:
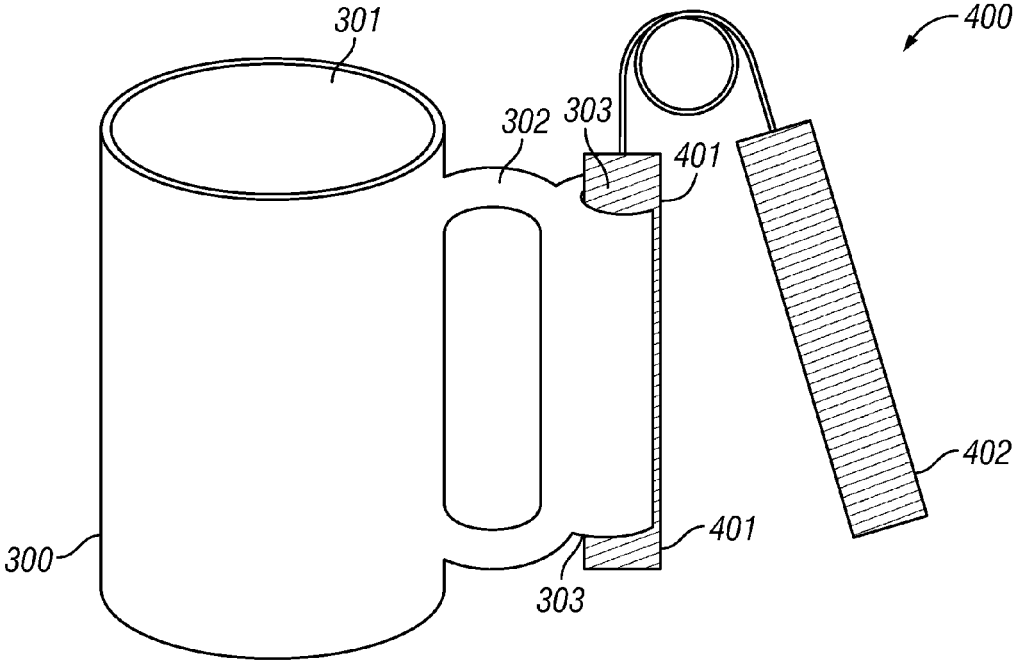

Another embodiment, in which a gripper is not necessarily an integral part of a mug, is shown in FIGS. 2(*a*) and 2(*b*). Beverage container 300 comprises a standard mug or cup like section 301 and also handle 302. Handle 302 in certain embodiments may be similar to a standard handle on any mug but handle 302 also includes coupler 303. In some circumstances coupler 303 is an integral part of handle 302. Coupler 303 is intended to be used such that standalone gripper 400 can be detachably attached to mug 300. In the embodiment shown in FIGS. 2(*a*) and 2(*b*) coupler 303 is shaped with a recessed area (or cavity) 304 such that grip 401 of gripper 400 can slide or snap into handle 302. FIG. 2(*a*) shows gripper 400 unattached and FIG. 2(*b*) shows gripper 400 detachable attached to mug 300. In other embodiments (not expressly shown) coupler 303 can include other nonpermanent couplers such as Velcro, straps, snaps, buttons, zippers, and so forth.

It may be desirable, but not necessary, for either coupler 303 or grip 401 (or both) to be a compressible material in order to make taking handgrip 400 on and off of mug 300 easier. If it is easy to attach and remove hand grip 400 from mug 300 then both items can easily be used alone and not in combination. For example, handgrip 400 can be taken off of mug 300 and used in a normal exercise routine unrelated to mug 300. Likewise, mug 300 can be used as a normal mug without the exercise apparatus once handgrip 400 is removed. For this reason, it may be desirable to make handle 302 and coupler 303 as comfortable as possible for a user should handgrip 400 be removed.

Figure 3:
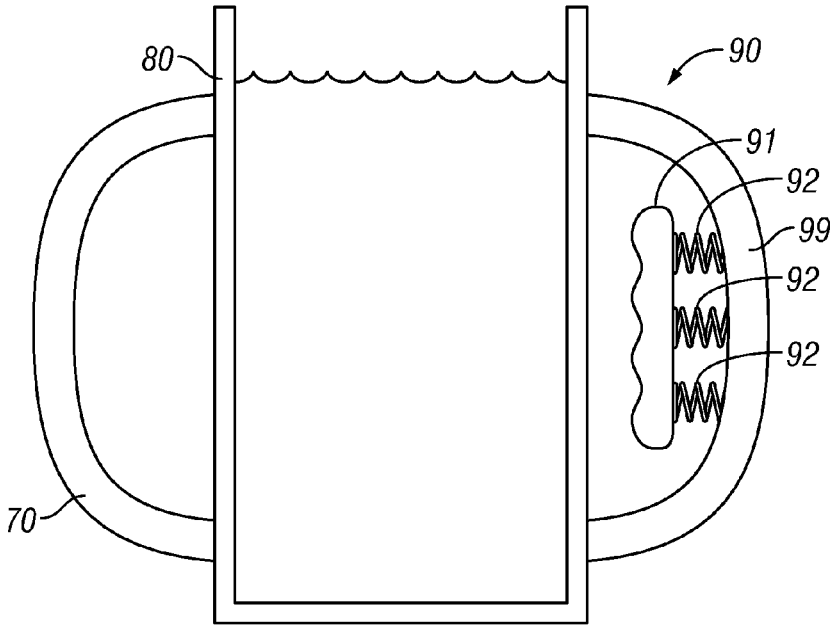
FIG. 3 is a cutaway view of a mug with two handles for weight distribution and in which at least one of the handles of the mug includes a gripper with multiple springs.

In yet another embodiment involving a mug, FIG. 3 shows a gripper included on the onside of the handle of the mug and also a second handle that can be used as counterbalance to the weight of the handle with the gripper. (It is also possible to have counterweights in the mug itself . . . not expressly shown). FIG. 3 shows mug 80 with handle 90. (Note: a mug as used herein can be any beverage container with a handle attached to it). In at least one embodiment, the handle includes gripper 99 with multiple springs. In FIG. 3 compressible device 99 comprises finger guides 91 attached to springs 92 which are attached to handle 90. A person drinking out of mug 80 can either simply hold mug 80 by using handle 90 and drink the contents of mug 80 or the user can decide to compress and release compressible device 99 using finger guides 91 in order to exercise. It may also be desirable to have a second handle 70 with no exercise component in order for the user of the mug to have a standard handle that is comfortable for the user when the user is not exercising. Second handle 70 may also be used as counter weight to handle 90 should compressible device 99 be heavy (in certain embodiments, not expressly shown, a counter weight may be included in the bottom of the mug itself).

Figures 4A, 4B, 5A:
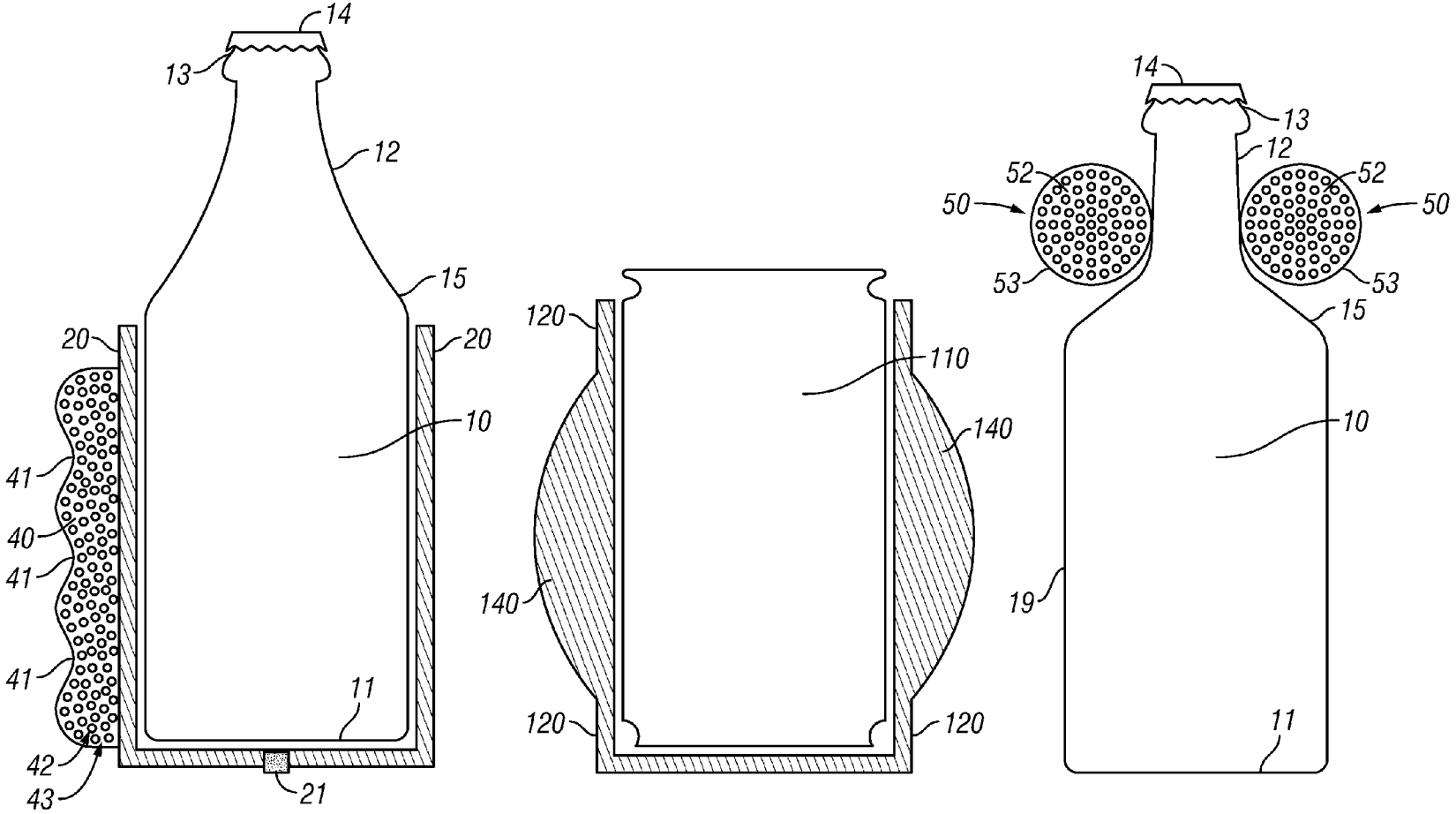
FIG. 4(*a*) is a cutaway view of a beverage bottle with an insulating beverage holder having a compressible area usable as an exercise apparatus.
FIG. 5(*a*) is a cutaway view of a beverage bottle with a compressible doughnut shaped insulating beverage holder that is slipped over the top of the bottle.
Figure 6:
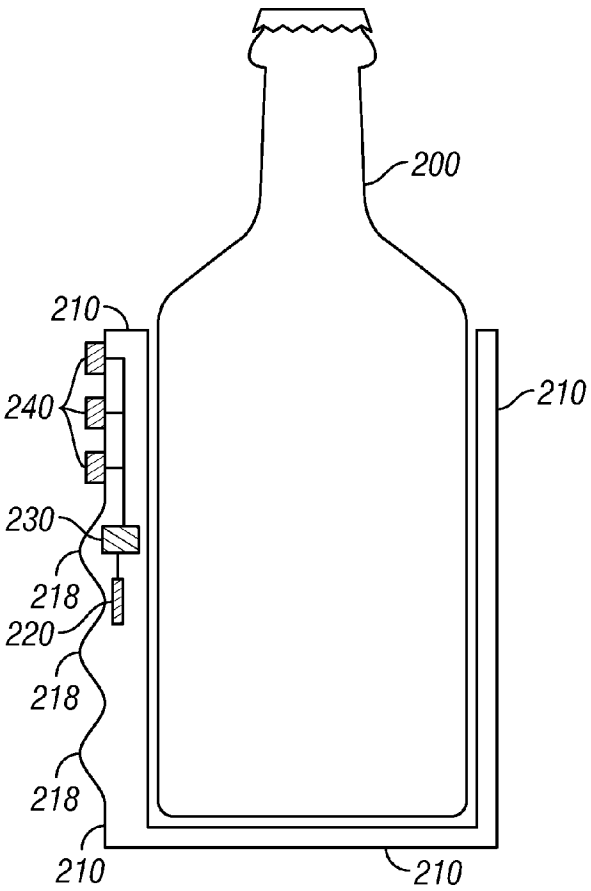
FIG. 6 is a cutaway view of a beverage bottle with an insulating beverage holder having a compressible area usable as an exercise apparatus. The apparatus also includes electronics which cause activation of either lights or audio.
Figure 5C:
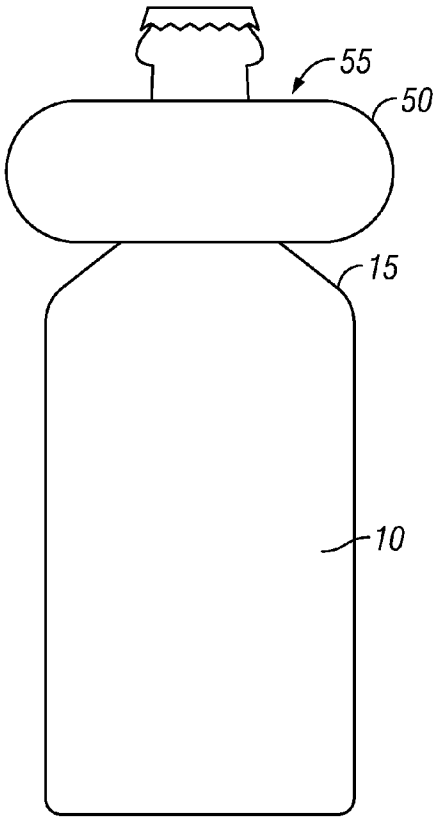
Figure 5B:
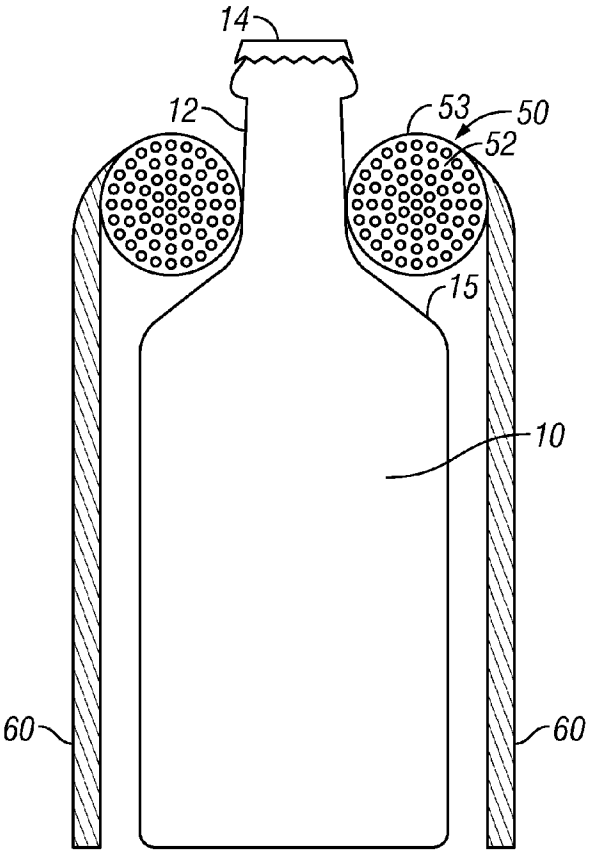

FIGS. 4-6 show embodiments that do not involve mugs or rigid primary beverage containers but instead secondary insulating beverage holders (i.e. holders not in direct contact with the beverage).

FIG. 4(*a*) shows a standard beverage bottle 10 with bottle bottom 11, and shoulder area 15 leading to narrower neck area 12. At the top of bottle 10 is opening 13 covered by bottle cap 14.

Surrounding bottle 10 is bottle holder/koozie 20 with hole 21 in the bottom of holder 20 to prevent vacuums. Bottle holders are well known in the art and have various uses including the following: (1) an insulator to keep ones beverage either cold or warm; (2) a holder to improve a user's grip on the bottle or can; and (3) a marketing tool using the surface of the bottle holder as advertising space. Common names for bottle and can holders include the following: Koozie™, coosie, beer sleeve, coolie, hugger, huggie, can cooler and so forth. In this disclosure the use of the word koozie and insulating beverage holders can be interchangeable.

The beverage holder of the subject invention is dramatically different than the standard koozie, because it also includes compressible device 40 which is intended to be used as an exercise apparatus. Typical insulating beverage holders are simple foam, polyester or neoprene cylinders with a foam base. The cylindrical part of the insulating beverage holders is typically as thin as possible to still have insulation properties. Such standard insulating beverage holders typically have a consistent thickness throughout the insulating beverage holders (except that perhaps the bottom of the insulating beverage holders bottom may be made of different material with a different thickness).

In at least one embodiment of the subject disclosure, gripper/compressible device 40 is attached to (or integral with) the outside surface of cylindrical holder 20. In the embodiment shown in FIG. 4(*a*), device 40 extends outward along one radius of the outside circumference of holder 20 and away from the bottle 10. Device 40s width and height are designed to make it comfortable for a user to grip bottle 10 with holder 20 around it with the user's four fingers resting on device 40. Compressible device 40 may have finger guides 41 that allow a user to more easily grip compressible device 40, holder 20 and accordingly bottle 10. When a user grasps bottle 10 they necessarily also grip holder 20 and their fingers may at times of their choosing fit into finger guides 41. A user can use device 40 simply as an improved gripping device for their beverage in some instances. In other instances they may choose to begin squeezing and releasing compressible device 40 for exercise that may be beneficial for their hands, wrists or forearms. Because in the embodiment shown in FIG. 4(*a*) compressible device 40 only covers a portion of holder 20 it is also possible that when a user does not want to exercise he simply holds the portion of holder 20 which does not include compressible device 40 (i.e. the user experience is no different than holding any standard koozie). These non-spring grippers may be more easily incorporated into insulating beverage holders because in some embodiments they can be made of the same or similar substances as the insulating beverage holder itself.

Compressible device 40 may be made in a variety of different ways and out of a variety of different substances such as rubbers, elastomers, foams and dry flowable particles. In one embodiment shown in FIG. 4(*a*), compressible device 40 is comprised of resilient covering 43 which holds dry particles 42. This type of compressible device is described in detail by the various Scatterday patents referenced above. It is also possible that compressible device 40 may be made of the same substance as the remainder of insulating beverage holder/koozie 20 and accordingly it is an integral part of holder 20. This situation may be workable in situations where the compressible material of device 40 is not only a good compressible material for exercising hands, wrists and forearms but also a good insulator (e.g. some open cell foam formulations have both characteristics).

FIG. 4(*b*) shows yet another embodiment of the disclosure where once again holder 120 is slipped over the bottom of can 110. In this embodiment of the disclosure, compressible device 140 is an integral part of holder 120 and holder 120 simply has a thicker, compressible area 140 that allows a user to compress thicker, compressible area 140 to get hand, wrist and forearm exercise. This embodiment may be preferable when holder 120 (and thus thicker compressible area 140) are made of materials that have both insulation properties and compressibility and resilience (e.g. memory) properties (e.g. open cell foams). In some embodiments, such as the one shown in FIG. 4(*b*), compressible area 140 extends around the entire circumference of bottle 110 and holder 120. In other embodiments (similar to FIG. 4(*a*)) compressible area 140 is only on portions of the radius of bottle holder 120 and may or may not include finger guides.

FIG. 5(*c*) shows another embodiment of the subject disclosure where doughnut shaped holder 50 is slid over the top of bottle 10 and the hole in holder 50 is sized so that it fits snugly on shoulder 15. (Inside surface 55 of doughnut shaped holder 50 may be textured in such a way that it grips glass or made of materials that grip glass (e.g. certain rubbers, neoprene, foams etc)). FIG. 5(*a*) shows a cutaway view of the bottle and doughnut shaped holder of FIG. 5(*c*). The embodiment shown in FIGS. 5(*a*) and 5(*c*) may be preferable when neck area 12 is long enough to accept holder 50 or when the diameter of bottle 10 is too large for a normal sized hand to use the embodiments shown in FIGS. 4(*a*) and 4(*b*).

Beverage holder 50 of FIG. 5(*a*) is a roughly doughnut shaped device, in that it has a hole in the middle allowing it be slipped over the top of bottle 10. Holder 50 is slipped over bottle cap 14, down neck 12 and then sits on shoulder 15. In this particular embodiment, holder 50 comprises resilient cover 53 that covers dry particles 52 (e.g. the Scatterday compression system). Holder 50 could also include other compressible materials such as gels, viscous fluids, rubbers, foams, and so forth). A user drinking from bottle 10 can hold onto the bottle by grasping holder 50. This person also has the option of doing hard, wrist and forearm exercises by squeezing and releasing holder 50. In some embodiments (not expressly shown) doughnut shaped holder 50 may also include finger guides similar to those in FIG. 5(*a*). In some cases it may be desirable to have additional insulation added to doughnut shaped holder 50. A user may also decide to simply hold bottle 10 in area 19 (a normal holding area somewhere near the middle of the bottle) and then move up to grab holder 50 and squeeze and release only at times when the user wants to exercise.

FIG. 5(*b*) shows a beverage holder similar to holder 50 in FIGS. 5(*a*) and 5(*c*). However, holder 50 in FIG. 5(*b*) also includes skirt 60 which may be desirable to either improve the insulation properties of holder 50 or to improve the gripping properties. Skirt 60 may be made of the same type materials typically used in koozies (e.g. neoprene, rubbers, open cell foams etc.)

FIG. 6 is a cut away view showing beverage bottle 200 surrounded by beverage holder 210. The configuration is similar to the embodiment of the invention shown in FIG. 1*a* except that the embodiment in FIG. 6 does not include the dry particles shown in FIG. 4(*a*) but instead the compressible material in finger guide area 218 is the same material used in the remainder of beverage holder 210 (e.g. rubber, neoprene etc). (Nothing prevents the embodiment of FIG. 6 including the dry particles of FIG. 4(*a*)).

The major difference between FIG. 4(*a*) and FIG. 6 is the inclusion of electronic components that trigger a light or audio activation. Light and audio activations in response to pressure when a product is used are well known in the art. An example includes LED lights in shoes that are triggered by the pressure of walking.

The light or audio embodiment shown in FIG. 6 is also easily adaptable with the mug embodiments shown in FIGS. 1-3.

FIG. 6 shows piezoelectric sensor 220 which is located or molded between finger guides 218 such that when the beverage holder 210 is squeezed pressure is put on piezoelectric sensor 220 comprised of a sheet or layer of polymeric piezoelectric material. Referring to FIG. 6 piezoelectric sensor 220 is also located or molded in beverage holder 210 and electrically connected to circuit 230 which may contains a battery pack (not expressly shown).

Circuit 230 when triggered by the piezoelectric impact sensor 218, energizes a light-emitting diodes (LEDs) 240. The LED(s) 240 may also be located or molded into the beverage holder 240.

In use, as the drinker of beverage bottle 200 squeezes beverage holder 210 piezoelectric sensor 220 produces a pulse of electrical energy each time finger guide area 218 of beverage holder 210 is squeezed or compressed by virtue of the piezoelectric effect. Each pulse of electrical energy from sensor 220 triggers a reaction from circuit 230 in ways well known in the art and disclosed in both patents '163 and '635.

Triggering circuit 230 allows LED(s) 240 to light for a time period determined by circuit 230. In another embodiment, not expressly shown, circuit 230 communicates with an audio device such as a speaker or transducer such that the beverage holder responds visually or audibly with the use of the exercise device. This capability allows for many interesting ways to either entertain the user or third parties or give the user information on his use of the apparatus. In certain embodiments where higher levels of energy are required (e.g. audio, video or dramatic lighting) the apparatus may include a battery or other power source. In this embodiment (not expressly shown) the piezo electric sensors trigger reactions in but do not necessarily power the displays since the battery can be used for this purpose.

Preferred embodiments of the present disclosure thus offer advantages over the prior art and are well adapted to carry out one or more of the objects of this disclosure. However, the present invention does not require each of the components and acts described above and is in no way limited to the above-described embodiments, methods of operation, variables, suggested shapes, values or value ranges. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

What is claimed is:

1. A beverage holder usable as an exercise apparatus, comprising: (1) a mug with an open top, wherein the mug includes a base, a sidewall extending from the base, said sidewall forming a rim at a distal end from the base, and wherein the rim is generally collinear with the sidewall and defines the open top of the mug; (2) a mug handle directly attached to or integral with the sidewall; and (3) a gripper exercise device comprising a gripper handle and the mug handle and at least one spring between the gripper handle and the mug handle.

2. The device of claim 1 wherein the at least one spring of the gripper exercise device has a first leg and a second leg.

3. The device of claim 2 wherein the first leg of the at least one spring of the gripper exercise device is permanently attached to the handle of the mug.

4. The device of claim 3 wherein the first leg is permanently attached to the mug handle using an injection over molding method.

5. The device of claim 2 wherein the mug handle has a cavity and the first leg of the spring is inserted into the cavity and attached to the mug handle with adhesive.

6. The device of claim 5 wherein the mug and mug handle with the cavity are injection molded.

* * * * *